US009430985B2

(12) United States Patent
Kim et al.

(10) Patent No.: US 9,430,985 B2
(45) Date of Patent: Aug. 30, 2016

(54) DISPLAY DEVICE AND METHOD OF DRIVING THE SAME

(71) Applicant: LG DISPLAY CO., LTD., Seoul (KR)

(72) Inventors: Young-Ho Kim, Paju-si (KR); Tae-Wook Lee, Paju-si (KR); Jae-Hak Kim, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 311 days.

(21) Appl. No.: 13/962,552

(22) Filed: Aug. 8, 2013

(65) Prior Publication Data

US 2014/0043317 A1 Feb. 13, 2014

(30) Foreign Application Priority Data

Aug. 8, 2012 (KR) ..... 10-2012-0086789
Dec. 28, 2012 (KR) ..... 10-2012-0156136

(51) Int. Cl.
*G09G 3/36* (2006.01)
*G09G 5/00* (2006.01)

(52) U.S. Cl.
CPC ..... *G09G 5/00* (2013.01); *G09G 3/3677* (2013.01); *G09G 3/3688* (2013.01); *G09G 2310/08* (2013.01); *G09G 2320/0233* (2013.01); *G09G 2330/06* (2013.01); *G09G 2340/16* (2013.01)

(58) Field of Classification Search
None
See application file for complete search history.

(56) References Cited

U.S. PATENT DOCUMENTS 7,142,187 B1 * 11/2006 Kim et al. ..... 345/100
2007/0159426 A1 * 7/2007 Shin ..... G09G 5/008 345/87
2009/0079718 A1 * 3/2009 Nakagawa ..... 345/204

FOREIGN PATENT DOCUMENTS

CN 1504988 A 6/2004
CN 101405940 A 4/2009
JP 2006-154820 A 6/2006
JP 2008-216606 A 9/2008

* cited by examiner

*Primary Examiner* — Seokyun Moon
(74) *Attorney, Agent, or Firm* — Birch, Stewart, Kolasch & Birch, LLP

(57) ABSTRACT

A display device including a display panel including gate and data line that cross each other; a first control signal generation unit generating a source output enable signal and a first gate output enable signal in synchronization with a data enable signal modulated according to a spread frequency clock signal; a second control signal generation unit starting to count a number of clocks of a fixed-frequency clock signal based on a point of time at which a first state of the source output enable signal ends, and outputting a second gate output enable signal when the counted number of the clocks becomes equal to a reference value; and a gate driving unit controlling an outputting of a gate signal to the gate lines using the second gate output enable signal.

16 Claims, 4 Drawing Sheets

DISPLAY DEVICE AND METHOD OF DRIVING THE SAME

The present application claims the priority benefit of Korean Patent Application Nos. 10-2012-0086789 and 10-2012-0156136 filed in Republic of Korea on Aug. 8, 2012 and Dec. 28, 2012, respectively, which are hereby incorporated by reference in its entirety.

BACKGROUND

1. Field of the Disclosure

The present disclosure relates to a display device, and more particularly, to a display device and a method of driving the same.

2. Discussion of the Related Art

With the advancement of information society, various types of display device capable of displaying an image have been developed. Recently, various flat panel display devices, such as a liquid crystal display (LCD), a plasma display panel (PDP), and an organic light emitting diode (OLED), have been used.

Among various flat panel display devices, an active matrix LCD device in which a switching transistor is formed in each of pixels arranged in a matrix has been commonly used.

Recently, a display device having high frequency and high resolution has been developed to display a high-quality image.

Thus, an amount of data transmitted between driving circuits that drives the display device increases, thereby generating the effect of electro-magnetic interference (EMI). To solve this problem, a spread spectrum technique has been suggested.

In the spread spectrum technique, by periodically changing a frequency in a particular frequency band, the frequency band is spread and signal transmission is performed based on the frequency in the spreading frequency band. Thus, EMI that may occur when a signal is transmitted at a particular frequency may be prevented.

However, in the related art spread spectrum technique, driving control signals are generated by a timing controller in synchronization with a spread frequency clock signal. Thus, a time of charging image data changes according to a change in a frequency of the spread frequency clock signal.

Accordingly, the time of charging the image data may change in units of horizontal periods or frames, and wavy noise may occur in this case, thereby degrading image quality.

SUMMARY OF THE INVENTION

Accordingly, the present invention is directed to a display device capable of preventing degradation in image quality and a method of driving the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a display device includes a display panel including gate and data lines that cross each other; a first control signal generation unit generating a source output enable signal and a first gate output enable signal in synchronization with a data enable signal modulated according to a spread frequency clock signal; a second control signal generation unit starting to count a number of clocks of a fixed-frequency clock signal at a point of time at which a logic high state of the source output enable signal ends, and outputting a second gate output enable signal when the counted number of the clocks becomes equal to a reference value; and a gate driving unit controlling an outputting of a gate signal to the gate lines using the second gate output enable signal.

In another aspect, a method of driving a display device includes generating a source output enable signal and a first gate output enable signal in synchronization with a data enable signal modulated according to a spread frequency clock signal through a first control signal generation unit; starting a counting of a number of clocks of a fixed-frequency clock signal at a point of time at which a logic high state of the source output enable signal ends, and outputting a second gate output enable signal when the counted number of the clocks becomes equal to a reference value, through a second control signal generation unit; and controlling an outputting of a gate signal from a gate driving unit to a display panel using the second gate output enable signal.

In another aspect, a display device includes a display panel including gate and data lines that cross each other; a first control signal generation unit that generates a source output enable signal and a first gate output enable signal in synchronization with a data enable signal modulated according to a spread frequency clock signal; a second control signal generation unit that starts to count a number of clocks of a fixed-frequency clock signal at a point of time at which a logic high state of the source output enable signal ends, and outputs a second gate output enable signal when the counted number of the clocks becomes equal to a reference value; a output control unit that outputs the first gate output enable signal as a gate output enable signal when a status of a current frame is judged to be abnormal under which a charging time of a horizontal line overlaps a output time of image data of a next horizontal line if the second gate output enable signal is applied in the current frame and outputs the second gate output enable signal as a gate output enable signal when a status of the current frame is judged to be normal under which the charging time of the horizontal line does not overlap the output time of image data of the next horizontal line if the second gate output enable signal is applied in the current frame; and a gate driving unit that controls an outputting of a gate signal to the gate line using the gate output enable signal output from the output control unit.

In another aspect, a method of driving a display device includes generating a source output enable signal and a first gate output enable signal in synchronization with a data enable signal modulated according to a spread frequency clock signal through a first control signal generation unit; starting a counting of a number of clocks of a fixed-frequency clock signal at a point of time at which a logic high state of the source output enable signal ends, and outputting a second gate output enable signal when the counted number of the clocks becomes equal to a reference value, through a second control signal generation unit; and outputting the first gate output enable signal as a gate output enable signal when a status of a current frame is judged to be abnormal under which a charging time of a horizontal line overlaps a output time of image data of a next horizontal line if the second gate output enable signal is applied in the current frame and outputting the second gate output enable signal as a gate output enable signal when a status of the current frame is judged to be normal under which the charging time of the horizontal line does not overlap the output time of image data of the next horizontal line if the second gate output enable signal is applied in the current frame, through an output control unit; and controlling an outputting of a gate signal from a gate driving unit to a display panel using the gate output enable signal from the output control unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to exemplary embodiments, examples of which are illustrated in the accompanying drawings.

Figure 1:
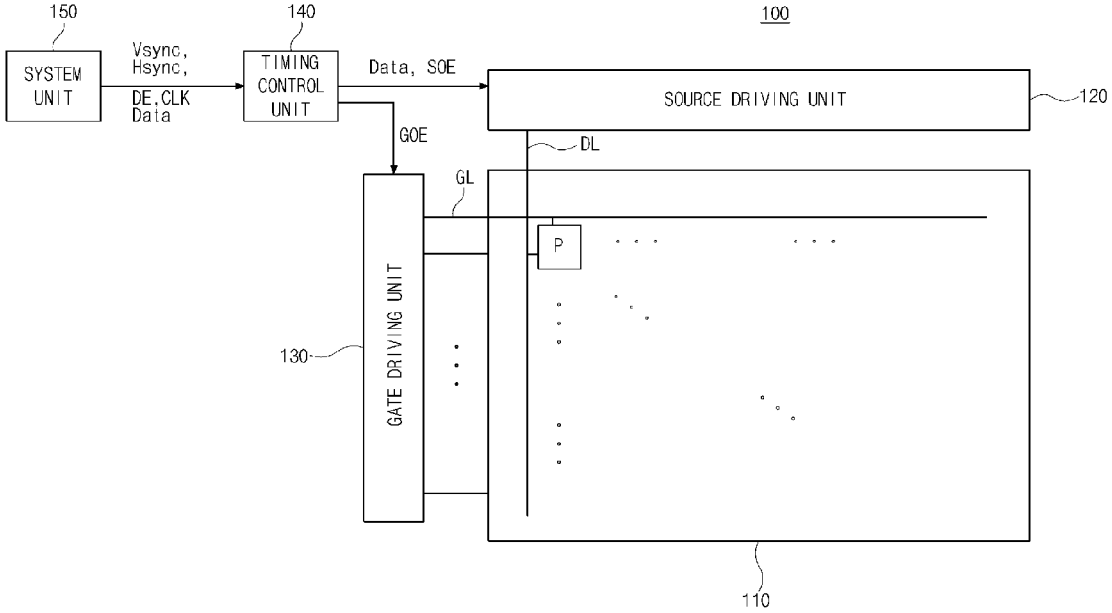
FIG. 1 is a schematic block diagram of a display device according to an embodiment of the present invention.
Figure 2:
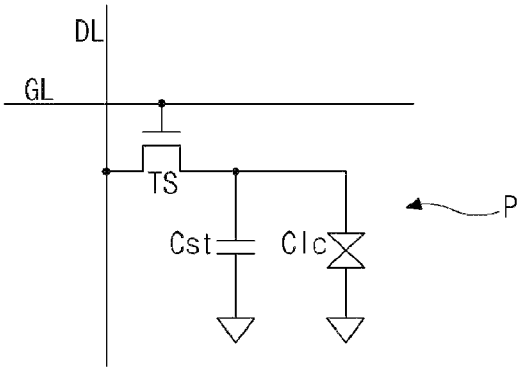
FIG. 2 is a schematic circuit diagram of a pixel of FIG. 1 according to the embodiment of the present invention.

FIG. 1 is a schematic block diagram of a display device according to an embodiment of the present invention. FIG. 2 is a schematic circuit diagram of a pixel of FIG. 1 according to the embodiment of the present invention.

Referring to FIGS. 1 and 2, the display device 100 may include a display panel 110 and a driving circuit unit that drives the display panel 110.

The driving circuit unit may include a source driving unit 120, a gate driving unit 130, a timing control unit 140, and a system unit 150.

The display panel 110 is configured to display an image, and includes a plurality of pixels P arranged in a matrix form. In the display panel 110, gate lines GL and data lines DL that cross one another are formed. Each of the gate lines GL and each of the data lines DL are connected to a corresponding pixel P among the plurality of pixels P.

The plurality of pixels P may include red (R) pixels displaying red, green (G) pixels displaying green, and blue (B) pixels displaying blue. The R, G, and B pixels may be alternately arranged in rows, and adjacent R, G, and B pixels may act as a unit of image display.

Examples of the display panel 110 may include various types of flat display panels, such as a liquid crystal display (LCD) panel, a field-emission display panel, a plasma display panel, an electroluminescent display panel (e.g., an inorganic field-effect electroluminescent panel and an organic light emitting diode panel), and an electrophoretic display panel.

When the display panel 110 is an LCD panel, the display device 100 may further include a backlight unit that supplies light to the LCD panel.

In this case, referring to FIG. 2, the pixel P may include a switching transistor TS and a liquid crystal capacitor Clc connected to the gate line GL and the data line DL. The liquid crystal capacitor Clc includes a pixel electrode and a common electrode that corresponds to each other, and a liquid crystal layer between the pixel electrode and the common electrode. The pixel P may further include a storage capacitor Cst for storing input image data therein.

When the display panel 110 is an organic light emitting diode panel, the pixel P may include a switching transistor connected to the gate line GL and the data line DL, a driving transistor connected to the switching transistor, and an organic light emitting diode connected to the driving transistor.

The timing control unit 140 receives timing signals, e.g., a vertical synchronization signal Vsync, a horizontal synchronization signal Hsync, a data enable signal DE, a data clock signal CLK from the system unit 150 via an interface, e.g., a low-voltage differential signaling (LVDS) interface or a transition minimized differential signaling (TMDS) interface.

The timing control unit 140 may generate a source control signal that controls the source driving unit 120 and a gate control signal that controls the gate driving unit 130, based on the timing signals. The source control signal includes a source output enable signal SOE that controls a timing at which image data is output from the source driving unit 120, and the gate control signal includes a gate output enable signal GOE that controls a timing at which a gate signal is output from the gate driving unit 130.

The timing control unit 140 receives image data Data in the form of a digital signal from the system unit 150, processes the image data Data, and supplies the processed image data Data to the source driving unit 120.

The source driving unit 120 may include, for example, a plurality of driving integrated circuits (ICs). The plurality of driving ICs may be connected to the corresponding data lines DL of the display panel 110 through a chip on glass (COG) process or a chip on film (COF) process.

The source driving unit 120 receives the processed image data Data and the source control signal from the timing control unit 140, and outputs image data in the form of an analog signal to the corresponding data line DL according to the source control signal. For example, the source driving unit 120 transforms the processed image data Data into image data in parallel form according to the source control signal, transforms the parallel image data into positive/negative polarity voltages, and applies the positive/negative polarity voltages to the corresponding data lines DL.

Although not shown, the display device 100 may include a gamma voltage unit. The gamma voltage unit generates gamma voltages and applies the gamma voltages to the source driving unit 120. A voltage corresponding to the image data Data in the form of a digital signal may be changed into analog voltage corresponding to the image data Data using the gamma voltages.

The gate driving unit 130 sequentially supplies a gate signal to the gate lines GL according to the gate control signal that is received directly from the timing control unit 140 or that is received via the source driving unit 120. The gate driving unit 130 may include a plurality of driving ICs but is not limited thereto. For example, the gate driving unit 130 may be formed in the display panel 110 through a gate in panel (GIP) method. In this case, the gate driving unit 130 is formed in a non-display region of an array substrate during manufacturing the array substrate.

The display device 100 having the structure as described above may be driven according to the spread spectrum technique. In this case, a time of charging the image data Data may be maintained constant by controlling timing of the gate output enable signal GOE, as will be described in detail with further reference to FIGS. 3 and 4 below.

Figure 3:
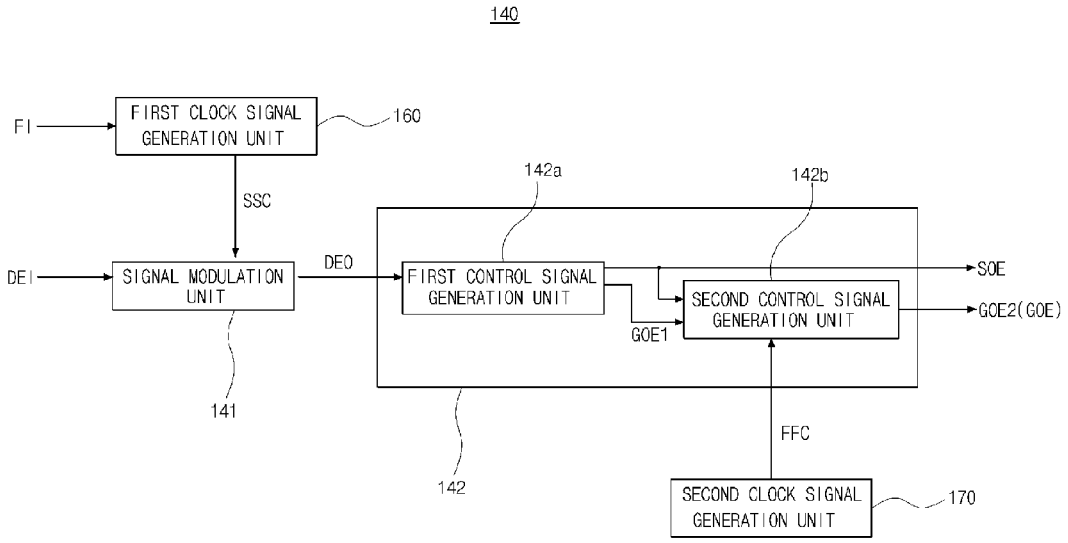
FIG. 3 is a schematic block diagram of a timing control unit according to the embodiment of the present invention.
Figure 4:
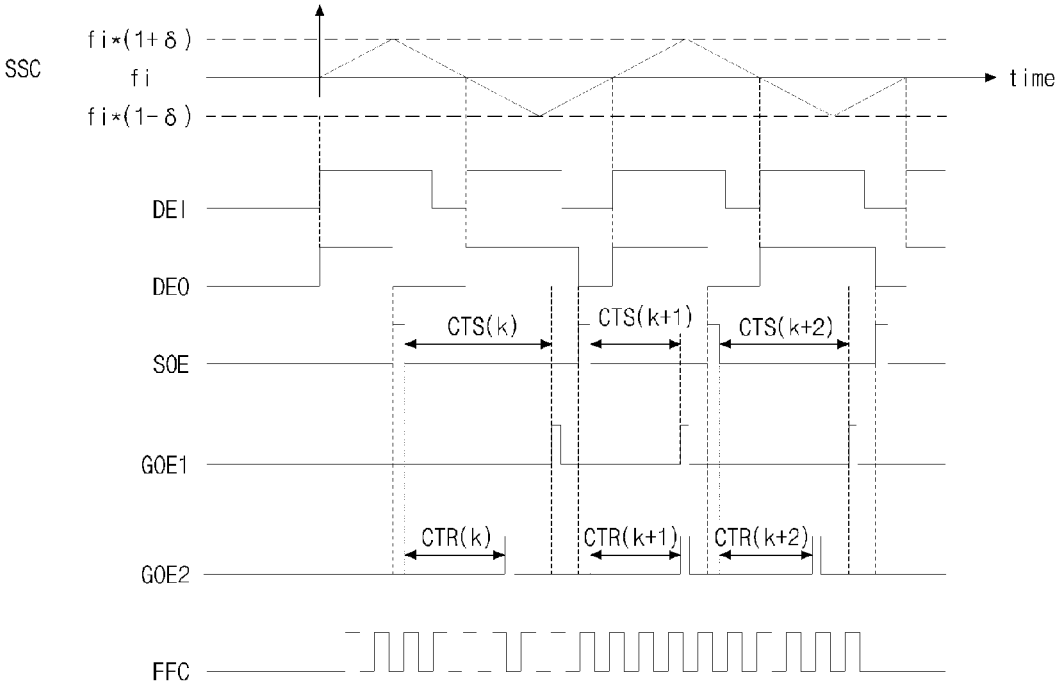
FIG. 4 is a timing diagram of signals for driving the display device according to the embodiment of the present invention.

FIG. 3 is a schematic block diagram of a timing control unit according to the embodiment of the present invention. FIG. 4 is a timing diagram of signals for driving a display device according to the embodiment of the present invention.

Referring to FIG. 3, the timing control unit 140 may include a signal modulation unit 141 and a control signal generation unit 142.

The signal modulation unit 141 may receive a data enable signal DEI, for example, from the system unit 150 of FIG. 1, modulate the data enable signal DEI, and output the modulated data enable signal DEO. According to the embodiment, for convenience of explanation, the data enable signal DEI input to the signal modulation unit 141 and the modulated data enable signal DEO output from the signal modulation unit 141 will be referred to as a first data enable signal DEI and a second data enable signal DEO, respectively.

Such a timing signal modulation process may be performed using a spread frequency clock signal SSC.

The spread frequency clock signal SSC may be generated by and output from a first clock signal generation unit 160 included in the display device 100. The first clock signal generation unit 160 receives an input frequency clock signal FI having a fixed frequency fi, and generates the spread frequency clock signal SSC by spreading the fixed frequency fi according to the spread spectrum technique.

The spread frequency clock signal SSC has a spread width (i.e., frequency band) of ($fi \times 2\delta$) with respect to the input frequency fi, and has a periodically changed frequency. In the embodiment, for convenience of explanation, a case in which a frequency of the spread frequency clock signal SSC changes periodically at intervals of two horizontal periods is described.

The frequency of the spread frequency clock signal SSC that varies according to time may have any of various shapes, e.g., a triangular wave shape and a sine wave shape. In the embodiment, for convenience of explanation, it is assumed that the frequency of the spread frequency clock signal SSC that varies according to time has the triangular wave shape.

The input frequency clock signal FI described above may be supplied from the system unit 150 but is not limited thereto. For example, the input frequency clock signal FI may be generated by the timing control unit 140.

The first clock signal generation unit 160 may be included in the timing control unit 140 but is not limited thereto. For example, the first clock signal generation unit 160 may be included in the system unit 150.

The spread frequency clock signal SSC generated as described above is supplied to the signal modulation unit 141. The signal modulation unit 141 modulates the first data enable signal DEI according to the spread frequency clock signal SSC.

In this connection, for example, when the frequency of the spread frequency clock signal SSC is higher than the input frequency fi, the frequency of a clock signal related to signal transmission, e.g., an internal clock signal, becomes high and signal transmission may thus be performed at high speeds. In contrast, when the frequency of the spread frequency clock signal SSC is lower than the input frequency fi, the frequency of the internal clock signal becomes low and signal transmission may thus be performed at low speeds. Thus, the signal modulation unit 141 may count the number of clocks of, for example, the internal clock signal, and modulate the first data enable signal DEI to output the modulated second data enable signal DEO by maintaining the first data enable signal DEI in an enable state, i.e., in a logic high state, until a result of the counting becomes equal to a set significant number.

Then, as illustrated in FIG. 4, when the frequency of the spread frequency clock signal SSC is higher than the input frequency fi, a point of time at which a logic high state of the second data enable signal DEO ends, i.e., a falling edge of the second data enable signal DEO, is advanced relative to the falling edge of the first data enable signal DEI. When the frequency of the spread frequency clock signal SSC is lower than the input frequency fi, the falling edge of the second data enable signal DEO is delayed relative to the falling edge of the first data enable signal DEI.

As described above, timing of input the second data enable signal DEO may change according to a change in the frequency of the spread frequency clock signal SSC. That is, the timing of the second data enable signal DEO is also changed periodically.

As described above, the signal modulation unit 141 may modulate the first data enable signal DEI according to the spread frequency clock signal SSC and output the modulated second data enable signal DEO.

The output second data enable signal DEO is supplied to the control signal generation unit 142. The control signal generation unit 142 may include a first control signal generation unit 142*a* and a second control signal generation unit 142*b*.

The first control signal generation unit 142*a* generates a source output enable signal SOE and a gate output enable signal GOE1 using the second data enable signal DEO. The gate output enable signal GOE1 may be further modulated using another timing signal and clock signal. For convenience of explanation, the gate output enable signal GOE1 generated by and output from the first control signal generation unit 142*a* will now be referred to as a first gate output enable signal GOE 1.

The source output enable signal SOE and the first gate output enable signal GOE1 are generated in synchronization with the second data enable signal DEO. For example, the source output enable signal SOE is output at a falling edge of the second data enable signal DEO, and the first gate output enable signal GOE1 is output at a predetermined point of time before the falling edge of the second data enable signal DEO.

As described above, the timing of the falling edge of the second data enable signal DEO varies according to change of clock signal frequency, thereby changing timings of the source output enable signal SOE and the first gate output enable signal GOE1.

Thus, an interval between a point of time at which a logic high state of the source output enable signal SOE ends, i.e. a falling edge of the source output enable signal SOE, and a point of time at which a logic high state of the first gate output enable signal GOE1 starts, i.e., a rising edge of the first gate output enable signal GOE1, also changes periodically.

Accordingly, in the related art in which image data is charged using the source output enable signal SOE and the first gate output enable signal GOE1, a time of charging the image data may change according to change of clock signal frequency, thereby generating wavy noise.

To address this problem, according to the embodiment of the present invention, the second control signal generation unit 142*b* is configured to control timing of outputting the gate output enable signal GOE supplied to the gate driving unit 130. In other words, the first gate output enable signal GOE1 is modulated to generate the gate output enable signal GOE (i.e., a second gate output enable signal GOE2), the output timing of which is controlled to uniformize the time of charging the image data, as will be described in detail below.

For convenience of explanation, the interval between the falling edge of the source output enable signal SOE and the rising edge of the first gate output enable signal GOE1 will be referred to as a variable charging time (CTS).

The second control signal generation unit 142*b* receives the source output enable signal SOE, the first gate output enable signal GOE1, and a fixed-frequency clock signal FFC, and modulates the first gate output enable signal GOE1 using the source output enable SOE and the fixed-frequency clock signal FFC to generate the second gate output enable signal GOE2.

The fixed-frequency clock signal FFC may be generated by the second clock signal generation unit 170 that is not influenced by the spread spectrum technique. Thus, even if a display device is driven according to the spread spectrum technique, the fixed-frequency clock signal FFC having a fixed frequency may be generated and supplied.

The second clock signal generation unit 170 may be a voltage-controlled oscillator (VCO) that is not influenced by the spread spectrum technique but is not limited thereto. The second clock signal generation unit 170 may be included in the timing control unit 140 but is not limited thereto. For example, the second clock signal generation unit 170 may be included in the system unit 150 outside the timing control unit 140.

The second control signal generation unit 142*b* counts the number of clocks of the fixed-frequency clock signal FFC. Specifically, for example, the number of clocks of the fixed-frequency clock signal FFC from a falling edge of the source output enable signal SOE to a corresponding rising edge of the first gate output enable signal GOE 1 is counted in unit of rows, i.e., in unit of horizontal periods, of an $(m-1)^{th}$ frame. In other words, the number of clocks of the fixed-frequency clock signal FFC within the variable charging time CTS is counted. For convenience of explanation, the number of clocks counted within the variable charging time CTS is referred to as a first count value.

Then, an average of first count values is calculated. For example, if the number of horizontal periods (rows) is n and a first count value in a $k^{th}$ horizontal period is CK(k), an average Avg of first count values in the $(m-1)^{th}$ frame may be calculated using an equation:

$$\mathrm{Avg}(m-1)=(CK(1)+\ldots+CK(n))/n.$$

The second gate output enable signal GOE2 in an $m^{th}$ frame may be generated by setting the average Avg of the first count values in the $(m-1)^{th}$ frame as a reference value.

In this connection, for example, in the $m^{th}$ frame, the number of clocks of the fixed-frequency clock signal FFC based on a falling edge of the source output enable signal SOE is counted. For convenience of explanation, the number of clocks of the fixed-frequency clock signal FFC counted starting from the falling edge of the source output enable signal SOE is referred to as a second count value.

When the second count value becomes equal to a set reference value, i.e., an average Avg of first count values in the $(m-1)^{th}$ frame, the second gate output enable signal GOE2 is generated and output.

Thus, timings of outputting the second gate output enable signal GOE (i.e., the second gate output enable signal GOE2) in respective horizontal periods in the $m^{th}$ frame can be constant with respect to timings of outputting the source output enable signal SOE. Thus, even if the timing of outputting the source output enable signal SOE changes according to the spread spectrum technique, the interval between the falling edge of the source output enable signal SOE and the rising edge of the gate output enable signal GOE, i.e., an actual time CTR of charging image data, may be maintained constant.

Thus, problems occurring when a time of charging image data periodically changes, e.g., wavy noise, may be prevented, thereby improving image quality of a display device.

As described above, according to an embodiment of the present invention, the number of clocks of a fixed-frequency clock signal is counted based on timing of a source output enable signal, and a gate output enable signal is output when the counted number of the clocks of the fixed-frequency clock signal becomes equal to a set value. Thus, even if the spread spectrum technique is employed, a time of charging image data may be uniformized.

Accordingly, wavy noise that may occur when the time of charging image data changes may be prevented, thereby improving image quality.

Abnormal events such as change of channel and change of driving mode may happen to the display device as driven above. In other words, change of TV channel, change from a normal mode to a sleep mode and the like may happen.

Figure 5:
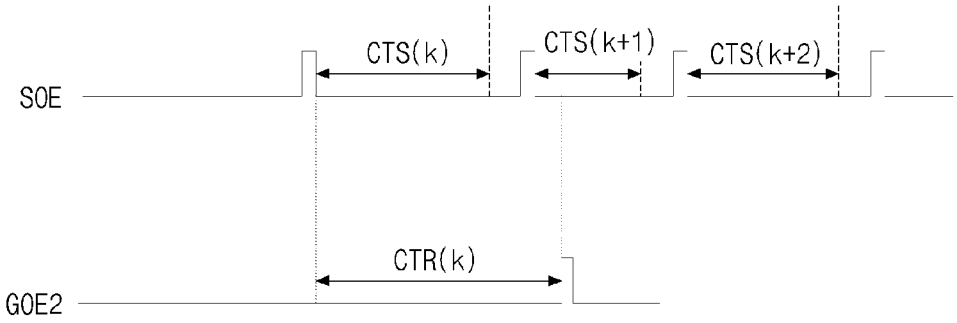
FIG. 5 is a view illustrating an abnormal status in which a charging time of image data of a current horizontal line overlaps an output timing of image data of a next horizontal line in the display device according to the embodiment of the present invention.

In the abnormal events, an average charging time CTR of the current frame which is obtained based on the source output enable SOE and the fixed-frequency clock signal FFC in the previous frame may be greater than a variable charging time CTS of the current frame, as shown in FIG. 5. In this case, a point of time at which an output of gate signal of a current horizontal line ends is later than a point of time at which an output of gate signal of a next horizontal line starts. In other words, a charging time of image data of current horizontal line overlaps an output time of image data of a next horizontal line. Accordingly, an abnormal signal output occurs, and display abnormality is caused.

Another embodiment to solve the above problem is explained with reference to FIGS. 6 and 7.

Figure 6:
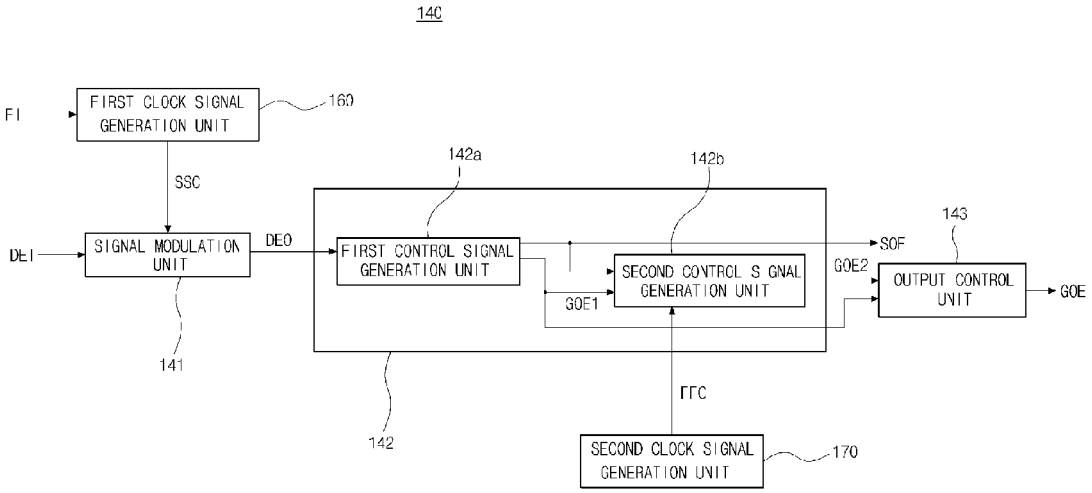
FIG. 6 is a schematic block diagram of a timing control unit a display device according to another embodiment of the present invention.
Figure 7:
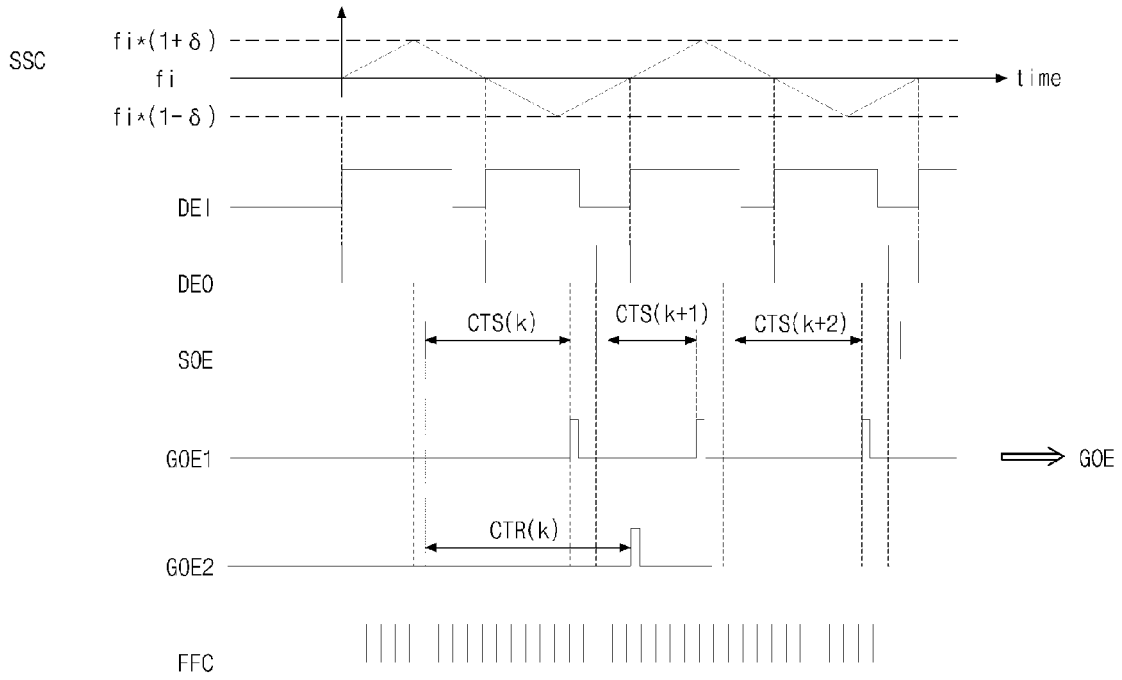
FIG. 7 is a timing diagram of signals for driving the display device according to another embodiment of the present invention.

FIG. 6 is a schematic block diagram of a timing control unit a display device according to another embodiment of the present invention. FIG. 7 is a timing diagram of signals for driving the display device according to another embodiment of the present invention.

The display device of another embodiment may be similar to that of the above-described embodiment except for configuration of the timing control unit. Accordingly, explanations of parts similar to parts of the above-described embodiment may be omitted.

Referring to FIG. 6, the timing control unit 140 may include a signal modulation unit 141 and a control signal generation unit 142. The timing control unit 140 may further include an output control unit 143.

The output control unit 143 receives a first gate output enable signal GOE1 from a first control signal generation unit 142*a* and a second gate output enable signal GOE2 from a second control signal generation unit 142*b*.

The output control unit 143 judges whether status of current frame is normal or abnormal. When the status of current frame is judged to be normal status, the second gate output enable signal GOE2 is finally output as a gate output enable signal GOE. To the contrary, when the status of current frame is judged to be abnormal status, the first gate output enable signal GOE1 is finally output as a gate output enable signal GOE.

The judgment is made by comparing a set value based on a reference obtained in a previous frame i.e., an average charging time of image data (CTR) with a characteristic value relevant to output of image data of a current frame.

In an instance, judgment of normal/abnormal status may be made by comparing horizontal periods. For example, a horizontal period corresponding to an average charging time of image data CTR is set, and a horizontal period of a first horizontal line of a current frame is obtained based on a source output enable signal SOE of the current frame.

Then, the horizontal period set according to the average charging time of image data CTR is compared with the horizontal period of the first horizontal line of the current frame. When the horizontal period of the first horizontal line is less than the horizontal period set according to the average charging time of image data CTR, the status is judged to be abnormal.

In other words, when the horizontal period based on the source output enable signal SOE of the current frame is less than the horizontal period set based on average charging time of image data CTR of the previous frame, if an average charging time of image data (CTR) of the previous frame is applied in the current frame, a charging time of image data of a horizontal line overlaps an output time of image data of a next horizontal line in the current frame, and this case means abnormal status.

Accordingly, this case is judged to be abnormal, and the first gate output enable signal GOE1 is finally output in the current frame.

To the contrary, when the horizontal period based on the source output enable signal SOE of the current frame is equal to or greater than the horizontal period set based on average charging time of image data CTR of the previous frame, the status is judged to be normal.

In other words, if an average charging time of image data (CTS) of the previous frame is applied in the current frame, a charging time of image data of a horizontal line does not overlap an output time of image data of a next horizontal line in the current frame, and this case means normal status.

Accordingly, this case is judged to be normal, and the second gate output enable signal GOE2 is finally output in the current frame.

As described above, normal/abnormal status can be judged by comparing horizontal periods, and the first and second gate output enable signal GOE1 and GOE2 can be selectively output. Therefore, display abnormality in abnormal event can be prevented.

In an alternative instance, judgment of normal/abnormal status may be made by comparing clock signals. For example, a frequency of a clock signal corresponding to an average charging time of image data CTR of a previous frame is set, and a frequency of a data clock signal (CLK of FIG. 1) of a current frame is obtained.

Then, the frequency set according to the average charging time of image data CTR of the previous frame is compared with the frequency of the clock signal CLK of the first horizontal line of the current frame. When the frequency of the clock signal of the first horizontal line is greater than the frequency set according to the average charging time of image data CTR, the status is judged to be abnormal.

In this connection, as the frequency of the clock signal CLK increases, an output of the source output enable signal becomes fast, and a horizontal period thus becomes short. Accordingly, when the frequency set according to the average charging time of image data CTR of the previous frame is less than the frequency of the clock signal of the current frame, if an average charging time of image data (CTR) of the previous frame is applied in the current frame, a charging time of image data of a horizontal line overlaps an output time of image data of a next horizontal line in the current frame, and this case means abnormal status.

Accordingly, this case is judged to be abnormal, and the first gate output enable signal GOE1 is finally output in the current frame.

To the contrary, when the frequency of the clock signal of the first horizontal line of the current frame is equal to or less than the frequency set according to the average charging time of image data CTR of the previous frame, the status is judged to be normal.

In other words, if an average charging time of image data (CTR) of the previous frame is applied in the current frame, a charging time of image data of a horizontal line does not overlap an output time of image data of a next horizontal line in the current frame, and this case means normal status.

Accordingly, this case is judged to be normal, and the second gate output enable signal GOE2 is finally output in the current frame.

As described above, normal/abnormal status can be judged by comparing frequencies of clock signals, and the first and second gate output enable signal GOE1 and GOE2 can be selectively output. Therefore, display abnormality in abnormal event can be prevented.

According to the above-described another embodiment, by comparing the set value according to the average charging time of image data obtained in the previous frame with a characteristic value relevant to the output timing of image data of the current frame, normal/abnormal status of output of image data is judged.

Accordingly, in case of the normal status, the average charging time of image data calculated in the previous frame is applied in the current frame, wavy noise can be prevented, thereby improving display quality.

Further, in case of the abnormal status, instead of the average charging time, the charging time of image data of the current frame is applied in the current frame, abnormal output of signal can be prevented, thereby preventing display abnormality.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. A display device comprising:

a display panel including gate and data lines that cross each other;

a first control signal generation unit that generates a source output enable signal and a first gate output enable signal in synchronization with a data enable signal modulated according to a spread frequency clock signal;

a second control signal generation unit that starts to count a number of clocks of a fixed-frequency clock signal at a point of time at which a logic high state of the source output enable signal ends, and outputs a second gate output enable signal when the counted number of the clocks becomes equal to a reference value, wherein the fixed-frequency clock signal is generated by a clock signal generation unit that is not influenced by the spread frequency clock signal;

an output control unit that outputs the first gate output enable signal as a gate output enable signal when a status of a current frame is judged to be abnormal under which a charging time of a horizontal line overlaps an output time of image data of a next horizontal line if the second gate output enable signal is applied in the current frame, and outputs the second gate output enable signal as a gate output enable signal when a status of the current frame is judged to be normal under which the charging time of the horizontal line does not overlap the output time of image data of the next horizontal line if the second gate output enable signal is applied in the current frame; and a gate driving unit that controls an outputting of a gate signal to the gate line using the second gate output enable signal.

2. The display device of claim 1, wherein the second control signal generation unit counts the number of clocks of the fixed-frequency clock signal from a point of time at which the logic high state of the source output enable signal ends to a point of time at which a logic high state of the first gate output enable signal starts, at each of n horizontal periods of an $(m-1)^{th}$ frame, m and n being positive integers; calculates the reference value by calculating an average of the numbers of clocks counted at every n horizontal periods; and generates the second gate output enable signal in an $m^{th}$ frame using the calculated reference value.

3. The display device of claim 1, further comprising another clock signal generation unit that receives an input frequency clock signal having a fixed frequency, and modulates the input frequency clock signal according to a spread spectrum technique to generate the spread frequency clock signal having a periodically changed frequency.

4. A method of driving a display device, the method comprising:

generating a source output enable signal and a first gate output enable signal in synchronization with a data enable signal modulated according to a spread frequency clock signal through a first control signal generation unit;

starting a counting of a number of clocks of a fixed-frequency clock signal at a point of time at which a logic high state of the source output enable signal ends, and outputting a second gate output enable signal when the counted number of the clocks becomes equal to a reference value, through a second control signal generation unit, wherein the fixed-frequency clock signal is generated by a clock signal generation unit that is not influenced by the spread frequency clock signal;

outputting the first gate output enable signal as a gate output enable signal when a status of a current frame is judged to be abnormal under which a charging time of a horizontal line overlaps an output time of image data of a next horizontal line if the second gate output enable signal is applied in the current frame, and outputting the second gate output enable signal as a gate output enable signal when a status of the current frame is judged to be normal under which the charging time of the horizontal line does not overlap the output time of image data of the next horizontal line if the second gate output enable signal is applied in the current frame, through an output control unit; and controlling an outputting of a gate signal from a gate driving unit to a display panel using the second gate output enable signal.

5. The method of claim 4, wherein the outputting of the second gate output enable signal comprises:

counting the number of clocks of the fixed-frequency clock signal from a point of time at which the logic high state of the source output enable signal ends to a point of time at which a logic high state of the first gate output enable signal starts, at each of n horizontal periods of an $(m-1)^{th}$ frame, wherein m and n are positive integers;

calculating the reference value by calculating an average of the numbers of clocks counted at every n horizontal periods; and generating the second gate output enable signal in an $m^{th}$ frame using the calculated reference value.

6. The method of claim 4, further comprising receiving an input frequency clock signal having a fixed frequency, and modulates the input frequency clock signal according to a spread spectrum technique to generate the spread frequency clock signal having a periodically changed frequency.

7. A display device comprising:

a display panel including gate and data lines that cross each other;

a first control signal generation unit that generates a source output enable signal and a first gate output enable signal in synchronization with a data enable signal modulated according to a spread frequency clock signal;

a second control signal generation unit that starts to count a number of clocks of a fixed-frequency clock signal at a point of time at which a logic high state of the source output enable signal ends, and outputs a second gate output enable signal when the counted number of the clocks becomes equal to a reference value;

an output control unit that outputs the first gate output enable signal as a gate output enable signal when a status of a current frame is judged to be abnormal under which a charging time of a horizontal line overlaps an output time of image data of a next horizontal line if the second gate output enable signal is applied in the current frame, and outputs the second gate output enable signal as a gate output enable signal when a status of the current frame is judged to be normal under which the charging time of the horizontal line does not overlap the output time of image data of the next horizontal line if the second gate output enable signal is applied in the current frame; and a gate driving unit that controls an outputting of a gate signal to the gate line using the gate output enable signal output from the output control unit.

8. The display device of claim 7, wherein the status of the current frame is judged to be abnormal when a horizontal period of a first horizontal line of the current frame is less than a horizontal period set according to the reference value of the previous frame and the status of the current frame is judged to be normal when the horizontal period of the first horizontal line of the current frame is equal to or greater than the horizontal period set according to the reference value of the previous frame.

9. The display device of claim 7, wherein the status of the current frame is judged to be abnormal when a frequency of a clock signal of a first horizontal line of the current frame is greater than a frequency set according to the reference value of the previous frame and the status of the current frame is judged to be normal when the frequency of the clock signal of the first horizontal line of the current frame is equal to or less than a frequency set according to the reference value of the previous frame.

10. The display device of claim 7, wherein the second control signal generation unit counts the number of clocks of the fixed-frequency clock signal from a point of time at which the logic high state of the source output enable signal ends to a point of time at which a logic high state of the first gate output enable signal starts, at each of n horizontal periods of the previous frame, n being a positive integer; calculates the reference value by calculating an average of the numbers of clocks counted at every n horizontal periods; and generates the second gate output enable signal of the current frame using the calculated reference value.

11. The display device of claim 7, further comprising a clock signal generation unit that receives an input frequency clock signal having a fixed frequency, and modulates the input frequency clock signal according to a spread spectrum technique to generate the spread frequency clock signal having a periodically changed frequency.

12. A method of driving a display device, comprising:

generating a source output enable signal and a first gate output enable signal in synchronization with a data enable signal modulated according to a spread frequency clock signal through a first control signal generation unit;

starting a counting of a number of clocks of a fixed-frequency clock signal at a point of time at which a logic high state of the source output enable signal ends, and outputting a second gate output enable signal when the counted number of the clocks becomes equal to a reference value, through a second control signal generation unit;

outputting the first gate output enable signal as a gate output enable signal when a status of a current frame is judged to be abnormal under which a charging time of a horizontal line overlaps an output time of image data of a next horizontal line if the second gate output enable signal is applied in the current frame, and outputting the second gate output enable signal as a gate output enable signal when a status of the current frame is judged to be normal under which the charging time of the horizontal line does not overlap the output time of image data of the next horizontal line if the second gate output enable signal is applied in the current frame, through an output control unit; and controlling an outputting of a gate signal from a gate driving unit to a display panel using the gate output enable signal from the output control unit.

13. The method of claim 12, wherein the status of the current frame is judged to be abnormal when a horizontal period of a first horizontal line of the current frame is less than a horizontal period set according to the reference value of the previous frame and the status of the current frame is judged to be normal when the horizontal period of the first horizontal line of the current frame is equal to or greater than the horizontal period set according to the reference value of the previous frame.

14. The method of claim 12, wherein the status is judged to be abnormal when a frequency of a clock signal of a first horizontal line of the current frame is greater than a frequency set according to the reference value of the previous frame and the status of the current frame is judged to be normal when the frequency of the clock signal of the first horizontal line of the current frame is equal to or less than a frequency set according to the reference value of the previous frame.

15. The method of claim 12, wherein the outputting of the second gate output enable signal comprises:

counting the number of clocks of the fixed-frequency clock signal from a point of time at which the logic high state of the source output enable signal ends to a point of time at which a logic high state of the first gate output enable signal starts, at each of n horizontal periods of the previous frame, wherein n is a positive integer;

calculating the reference value by calculating an average of the numbers of clocks counted at every n horizontal periods; and generating the second gate output enable signal of the current frame using the calculated reference value.

16. The method of claim 12, further comprising receiving an input frequency clock signal having a fixed frequency, and modulating the input frequency clock signal according to a spread spectrum technique to generate the spread frequency clock signal having a periodically changed frequency.

* * * * *